United States Patent [19]

Alberti

[11] Patent Number: 5,036,499

[45] Date of Patent: Jul. 30, 1991

[54] WATCH FOR SAILING RACES

[75] Inventor: Damiano Alberti, Bovisio, Italy

[73] Assignee: Artime S.P.A., Naples, Italy

[21] Appl. No.: 616,776

[22] Filed: Nov. 20, 1990

[51] Int. Cl.[5] ..... G04B 47/00; G04B 19/00

[52] U.S. Cl. ..... 368/10; 368/223

[58] Field of Search ..... 368/3, 10, 76, 80, 223–232

[56] References Cited

U.S. PATENT DOCUMENTS 4,158,947 6/1979 Humphrey ..... 368/234

4,783,773 11/1988 Houlihan et al. ..... 368/240

*Primary Examiner*—Vit W. Miska

*Attorney, Agent, or Firm*—Bucknam and Archer

[57] ABSTRACT

A watch for sailing races comprises a watch casing having a dial having marks for indicating hours and minutes and related pointers, the watch further comprising an inclinometer comprising a sector at least partially overlaying the dial and provided with arrows for indicating the inclination angle, which arrows can be registered with registering marks provided on the dial front protecting glass member.

5 Claims, 1 Drawing Sheet

1
2
3
4
5
6
10
11
12
20
21
30
31
40
N
S
E
W
0
15
30
45
60
90
120
150
210
240
300
330

WATCH FOR SAILING RACES

BACKGROUND OF THE INVENTION

The present invention relates to a watch which has been specifically designed for sailing races.

A lot of watch assemblies are already known which, in addition to a conventional function of indicating the time, are also provided with other additional elements for indicating data relating to different sports.

However, at present there is not available a watch assembly specifically adapted to provide data relating to sailing races.

SUMMARY OF THE INVENTION

Accordingly, the aim of the present invention is to meet the above mentioned requirements by providing a watch which is specifically designed for sailing races and is adapted to provide a person participating to a sailing race with useful data relating to the sailing race itself.

Within the scope of the above mentioned aim, a main object of the present invention is to provide such a watch for sailing races which has a size comparable to that of a coventional watch, while comprising several fittings which have been specifically designed for the above mentioned use.

Another object of the present invention is to provide such a watch for sailing races which is very reliable and can be easily made starting from easily available elements and materials.

According to one aspect of the present invention, the above mentioned aim and objects, as well as yet other objects, which will become more apparent hereinafter, are achieved by a watch for sailing races including a watch body having a casing with a dial provided with marks for indicating the hours and minutes, and pointer members, characterized in that said watch further comprises an inclinometer comprising a sector at least partially overlaying said dial and provided with arrows for indicating an inclination angel, said arrows being adapted to be registered with registering marks arranged on a front protecting glass member of said dial.

BRIEF DESCRIPTION OF THE DRAWING

Further characteristics and advantages of the invention will become more apparent from the following detailed disclosure of a watch, specifically designed for sailing races, which is schematically shown in the accompanying drawing, where.

DESCRIPTION OF THE PREFERRED EMBODIMENT

Figure 1:
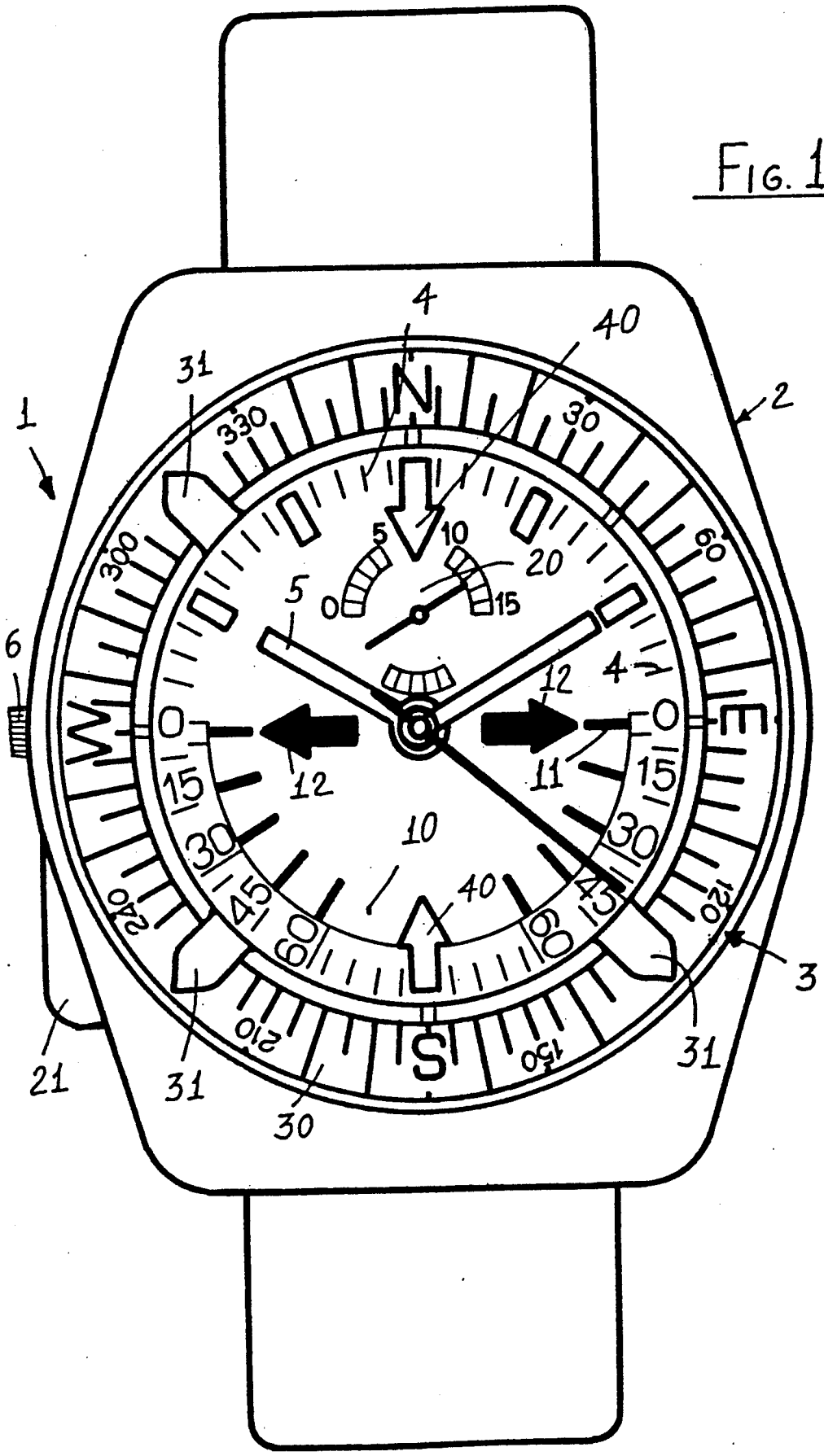
FIG. 1 is a front top plan view of the watch for sailing races according to the invention.

With reference to the figure of the accompanying drawing, the watch according to the present invention, which has been specifically designed for sailing races, comprises a watch body, indicated overally at the reference number 1, which is provided with a watch casing 2, advantageously of the waterproof type, with a water resistance up to 200 meters, said casing being closed at the top thereof by a glass member.

Within the casing, there is arranged a watch dial, overally indicated at the reference number 3, thereon, in a conventional way, there are provided marks 4 for indicating hours and minutes, and which can be read out through conventional pointers 5 which can be driven by a screw crown 6 arranged on the outside of the dial.

A first main feature of the present invention is that, on the watch dial, there is provided an inclinometer, comprising a semicircular shape sector 10 which is coaxially swingably mounted with respect to the turning axis of the pointers.

This device comprises arrows 12 for indicating the inclination angle, which can be detected by causing the inclinometer arrows to register with marks 11 provided on the glass member and, advatageously, screenprinted thereon.

Moreover, the watch further comprises a timer 20, for counting the time between a starting signal and the actual starting instant, which is set in 15 minutes.

The mentioned timer affords the possibility of precisely counting this time period so as to provide the person participating to the sailing race with absolutely safe data relating to a proper starting.

The timer can be actuated by a push-button 21 projecting on the outside of the watch casing.

The watch dial is also provided with a peripheral crown, indicated at 30, thereon there are provided the angle marks, as well as the indications of the cardinal points.

Moreover, on this peripheral crown operates a calculating element for calculating the sailing angle, said calculating element comprising three reference pointers, indicated at 31, which are mutually offset by 90° from one another, so that the two outer-most pointers are mutually aligned.

The watch further comprises a pair of pointers 40 respectivley arranged at the 6 and 12 hour positions of a conventional watch.

From the above disclosure it should be apparent that the watch according to the invention comprises elements which have been specifically designed for an application to a sailing race field, and these elements are arranged in a very reduced space comparable to that of a conventional watch.

While the invention has been disclosed and illustrated with reference to a preferred embodiment thereof, it should be apparent that the disclosed embodyment is susceptible to several modifications and variations, all of which come within the spirit and scope of the appended claims.

I claim:

1. A watch for sailing races including a watch body having a casing with a dial provided with marks for indicating the hours and minutes, and pointer members, characterized in that said watch further comprises an inclinometer comprising a sector at least partially overlaying said dial and provided with arrows for indicating an inclination angle, said arrows being adapted to be registered with registering marks arranged on a front protecting glass member of said dial.

2. A watch according to claim 1, wherein said inclinometer comprises a semicircular sector which is coaxially swingably mounted with respect to a turning axis of said pointers.

3. A watch according to claim 1, wherein said watch further comprises a timer pointer for counting a time period between a starting signal and an actual staring instant, said timer being actuated by a push-button arranged on said casing.

4. A watch according to claim 1, wherein said watch further comprises a dial outer crown member wherein angle marks are arranged.

5. A watch according to claim 1, wherein said watch further comprises a calculating element for calculating a sailing angle, said calculating element comprising three pointers arranged at an outer crown member of said watch and mutually offset of 90° .

* * * * *